United States Patent [19]

Yoneda

[11] Patent Number: 4,902,271

[45] Date of Patent: Feb. 20, 1990

[54] RADIO CONTROLLED STEERING DEVICE FOR A TWO-WHEELED VEHICLE TOY

[75] Inventor: Yousuke Yoneda, Tokyo, Japan

[73] Assignee: Tomy Kogyo Co., Inc., Tokyo, Japan

[21] Appl. No.: 307,465

[22] Filed: Feb. 8, 1989

[30] Foreign Application Priority Data

Feb. 12, 1988 [JP] Japan ..... 63-17240[U]

[51] Int. Cl.[4] ..... A63H 17/21

[52] U.S. Cl. ..... 446/440; 446/431

[58] Field of Search ..... 446/431, 440, 448, 449, 446/454, 455, 456, 457, 460, 468, 470

[56] References Cited

U.S. PATENT DOCUMENTS 3,751,851 8/1973 Nagai ..... 446/440
4,267,663 5/1981 Nagahara ..... 446/440
4,290,228 9/1981 Goldfarb et al. ..... 446/440 X
4,342,175 8/1982 Cernansky ..... 446/456 X
4,601,674 7/1986 Koizumi ..... 446/440

FOREIGN PATENT DOCUMENTS 2087740 6/1982 United Kingdom ..... 446/440
2130495 6/1984 United Kingdom ..... 446/440

*Primary Examiner*—Robert A. Hafer
*Assistant Examiner*—Sam Rimell
*Attorney, Agent, or Firm*—Staas & Halsey

[57] ABSTRACT

A radio controlled steering device for a two-wheeled vehicle toy has a tiltable rear wheel movable to a tilting direction by a servo motor. Tilting of the rear wheel shifts the center of gravity to either side of the normal center of gravity to induce rotation of the front wheel in the direction of tilt of the rear wheel.

8 Claims, 2 Drawing Sheets

RADIO CONTROLLED STEERING DEVICE FOR A TWO-WHEELED VEHICLE TOY

BACKGROUND OF THE INVENTION

1. Field of the Invention

The present invention relates to a steering device which allows a two-wheeled vehicle toy to move right and left using a radio control system.

2. Description of the Related Art

Known steering devices for a vehicle having front and rear wheels do not allow a steering wheel to be directly steered right and left other than that for a four-wheeled vehicle, because the weight of the vehicle is left unbalanced and the unbalanced weight may cause the vehicle to fall down at the extreme ends. As disclosed in the Japanese Patent Laid-open No. 57-64076, a device for steering a two-wheel car has employed the construction wherein a gondola-like frame mounting a servo mechanism and other weight members is suspended in a body frame in a rocking state and is moved right and left in a manner to allow the center of gravity of a body to move by means of a radio control system. Further, the Japanese Utility Model Publication No. 52-24078, for steering a two-wheeled vehicle, discloses a construction wherein a weight drop retained on the body is allowed to move right and left on the center axis using a radio control system so as to force the two-wheeled vehicle to be in the banking state. Other than the foregoing conventional techniques, Japanese Utility Model Laid-open No. 55-156799 discloses a steering construction characterized by providing a shaft along the center axis of a vehicle body on the tip of a vehicle frame supporting a rear wheel. Rotatably fitted to this shaft is a connecting block having a handle shaft of a front wheel fitted thereto. The connecting block is rotated on the shaft served as a fulcrum using a servo motor, so as to force the car body to be in the banking state by curving the body.

Rocking a weight drop or weight members right and left, as disclosed in Japanese Laid-open No. 57-64076 and Japanese Utility Model Publication No. 52-24078, requires excessive output of the servo motor and has slow response against a steering wheel, thereby making it impossible to rapidly steer the two-wheeled vehicle. Further, Japanese Utility Model Laid-open No. 55-156799 employs a construction wherein the inclined handle shaft causing a caster effect is fitted to the shaft provided on the center axis of a vehicle body and is rotated on the shaft served as a fulcrum by a servo motor. However, the force of the vehicle going straight is inherently acted on the front wheel having the inclined front fork rotatably fitted thereto while the vehicle is running with the center of gravity of a car body placed on the center axis. Rotating the handle shaft directly must be done against the force of the vehicle going straight, so that the rotation needs extra force accordingly. Moreover, though the handle shaft itself is preferable to be freely supported, in this case, it is connected to the servo mechanism, thereby giving an obstacle to the straight travel of the front wheel.

SUMMARY OF THE INVENTION

An object of the present invention is to solve the foregoing problems, and is characterized by supporting a front fork on the front end of a body in a manner to allow the front fork to swivel right and left, the upper end of the front fork being inclined rearward and the lower end thereof being mounted with a front wheel, providing a receiver, a servo motor and a power source in a frame mounted on the body, projecting on the rear end of the frame a shaft in the axial direction of the body, rotatably fitting on the shaft a supporting frame interlocked with the servo motor, providing on the supporting frame a drive motor and a rear wheel interlocked with the motor, the servo motor and drive motor being controlled in response to a receiving signal received by the receiver.

When the car is run by driving a rear wheel, the device of this invention is designed to drive a servo motor when the receiver provided on the frame receives a receiving signal for driving the servo motor and to steer the front wheel, that is, the steering wheel, right and left as corresponding to the displacement of the center of gravity by rotating the supporting frame rotatably fitted to the shaft of the frame in a manner to displace the center of gravity of the front wheel.

These objects, together with other objects and advantages which will be subsequently apparent reside in the details of construction and operation of the apparatus as more fully hereinafter described and claimed, reference being had to the accompanying drawings forming a part hereof, wherein like reference numerals refer to like parts throughout.

DETAILED DESCRIPTION OF THE PREFERRED EMBODIMENTS

Figure 1:
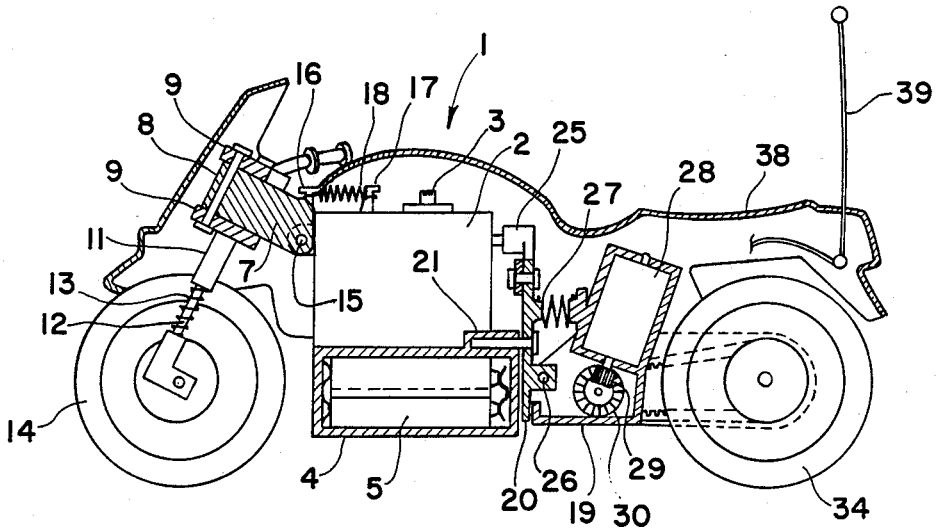
FIG. 1 is a side elevational view, partly in section, of a radio controlled steering device for a two-wheeled vehicle toy according to the present invention.

Referring to FIGS. 1–4, a frame 2 is located at the center of a body 1. On the front portion of the frame 2 is projected a bracket 7 for supporting a front fork 12. On the rear portion of the frame 2 is projected a shaft 21 for supporting a rear frame 31. A shell 38 is formed to have an appearance of a motorcycle and is mounted on the frame 2. The shell 38 extends over both sides and the top surfaces of the body from the front wheel 14 to the rear wheel 34.

An operation knob 3 for a power source switch extends upwardly from the top of the frame 2. A known receiver (not shown) and a known servo motor are built in the frame 2. The receiver is connected to a receiving antenna 39 upstanding on the rear portion of the cover 38. The antenna 39 receives a signal transmitted by a known transmitter (not shown) which outputs a control signal to the receiver. A battery storage section 4 is formed under the frame 2. A battery cell 5 stored in the section 4 serves as a power source for actuating the receiver, the servo motor 6 and a drive motor 28 to be described later. Further, the battery storage section 4 is located on the line extending between a front wheel 14 and a rear wheel 34 as shown in FIG. 1 and at the relatively lower portion of the body 1.

A projection provided on the front end of the frame 2 includes a supporting shaft 15 located in the horizontal direction of the projection. The base end of a bracket 7 is rotatably supported on the supporting shaft 15. One end of a tension spring 18 is fixed at the fixing piece 16 extending from the top of the bracket 7. The other end of the tension spring 18 is fixed at the fixing piece 17 extending from the top of the frame 2. The bracket 7 is rotated clockwise as shown in FIG. 1 by the tension string 18. The fulcrum of the rotation is on the supporting shaft 15. The base end of the bracket 7 is pressed on the front end of the frame 2 by the force of the tension spring 18. When the front wheel 14 collides with an obstacle in travel, the tension spring 18 serves as a shock absorber to cushion the impact since the bracket 7 is rotated counterclockwise as shown in FIG. 1 against the tension spring 18.

On the tip of the bracket 7 is mounted a supporting shaft 8, the upper and lower ends of which have a pair of triangular plates 9, 9 rotatably supported thereon. The triangular plates 9, 9 include sleeves 11, 11 penetrated therethrough. The front forks 12, 12 are slidably inserted into these sleeves 11, 11. The front wheel 14 is rotatably supported by the lower ends of the front forks 12, 12. Compression springs 13 wound on the front forks 12, 12 serve to absorb the impact applied from the road surface when the motorcycle is running. The upper ends of the front forks 12, 12 are inclined to rearward of the body 1. The front wheel 14 serves as a type of caster. That is, the front wheel 14 is mounted on the front forks 12, 12 rotatably supported on the supporting shaft 8 of the bracket 7. The upper ends of the front forks 12, 12 are inclined to rearward of the body 1. The center of gravity of the body 1 is located on the center axis of the body 1 so that the front wheel 14 may be kept in the straight travelling state.

Figure 2:
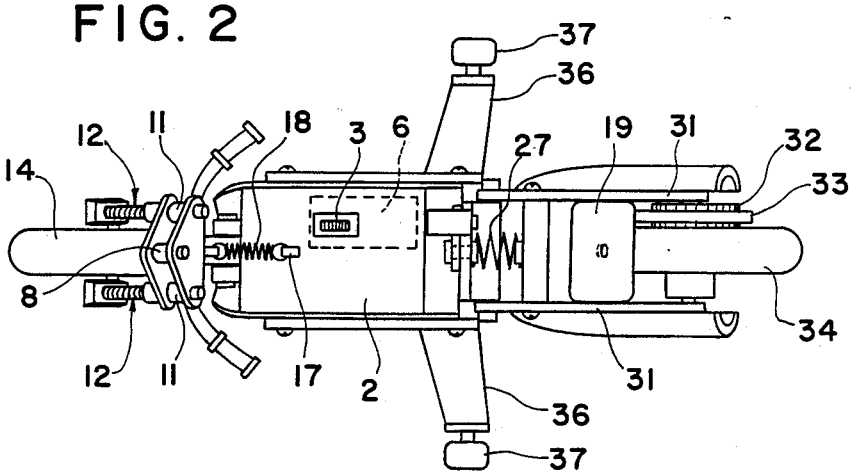
FIG. 2 is a top view of the vehicle toy shown in FIG. 1.

On the central portion of the rear end of the frame 2 is projected a shaft 21 along the center axis of the body 1. The shaft 21 rotatably supports the mount plate 20 forming the front wall of a supporting frame 19. One end of a connecting plate 24 is rotatably fitted to the upper end of the mount plate 20 by a pin 22. The other end of the connecting plate 24 is rotatably fitted to the tip of a rotating lever 25 by a pin 23. The base end of the rotating lever 25 is fitted to the motor shaft **6*a* of the servo motor 6 contained in the frame 2. The side wall of the supporting frame 19 is rotatably supported on a supporting shaft 26 bridged in the mount plate 20. A compression spring 27 extends between the mount plate 20 and the supporting frame 19 as shown in FIGS. 1 and 2. The compression spring 27 serves to absorb vibration transmitted from the road surface to the rear wheel. The supporting frame 19 is rotated on the shaft 21 served as a fulcrum together with the mount plate 20. The compression spring 27 is not essential. It may be replaced with an elastic material forming a tire portion of the rear wheel 34. In this case, the mount plate 20 is integrally formed with the supporting frame 19**.

The drive motor 28 is fixed on the supporting frame 19. A motor pinion 29 of the motor 28 engages a crown gear 30 fitted on a gear shaft journalled in the supporting frame 19. A sprocket 35 is fitted on the end of the gear shaft projected from the supporting frame 19. The rear wheel 34 is rotatably fitted on the tips of a pair of rear frames 31, 31 projected to rearward of the supporting frame 19. Between a sprocket 32 mounted on the rear wheel 34 and the sprocket 35 is an endless belt 33 having cogs formed on an inner peripheral surface thereof. The drive force of the motor 28 is thus transmitted to the rear wheel 34. Means for transmitting the driving force to the rear wheel 34, that is, the drive wheel may employ a chain in lieu of a belt 33. A transmission gear may be used for transmitting the driving force from the motor pinion to the rear wheel 34.

The supporting frame 19 has the foregoing construction. When the servo motor 6 contained in the frame 2 is driven, the mount plate 20 is rotated by a given angle on the interlocking mechanism between the top of the mount plate 20 and the servo motor 6. The rotation of the supporting frame 19 allows the motorcycle to be smoothly steered right and left without burdening the servo motor 6 with excessive load, because the shaft 21 supports the substantially central portion between the upper and lower ends of the mount plate 20 and the shaft 21 is located lower than the supporting shaft 8 of the front forks 12, 12.

Figure 3:
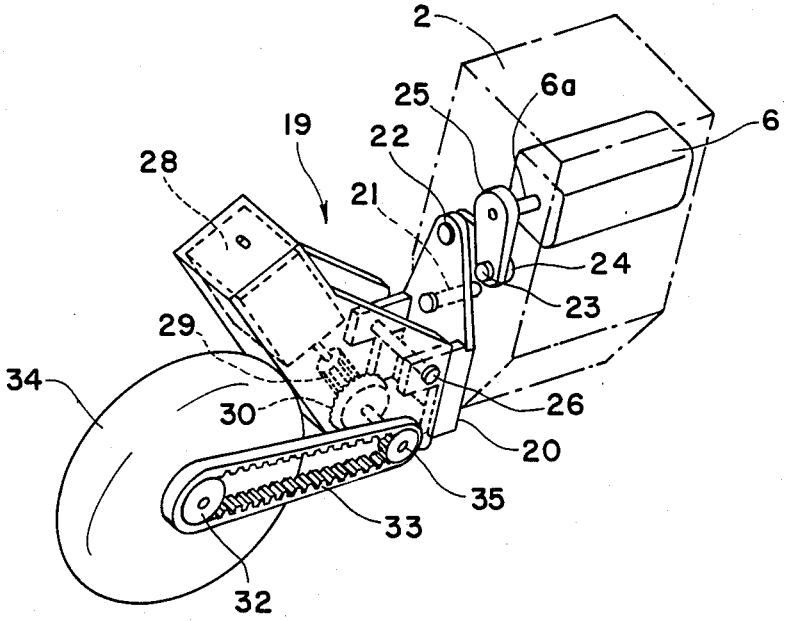
FIG. 3 is an enlarged perspective view, partly cutaway, of a portion of the vehicle toy illustrated in FIGS. 1 and 2.
Figure 4A:
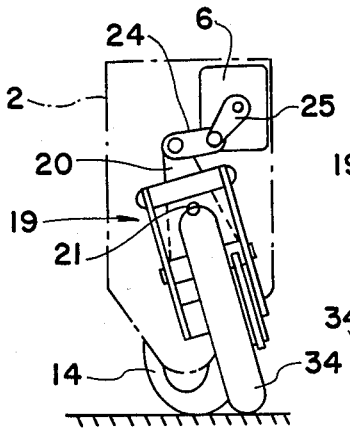
FIGS. 4*a* and 4*b* are front views of the vehicle toy of FIGS. 1–3 in different turning modes.

The operating process of steering the front wheel 14 right and left by rotating the supporting frame 19 on the shaft 21 of the fulcrum will be described with reference to FIGS. 3 and 4.

The compression spring 27 is not shown in FIG. 2 for convenience's sake.

The servo motor 6 is rotated by a given angle in response to a signal received by the receiver (not shown) provided in the frame 2. When the supporting frame 19 is rotated counterclockwise on the supporting shaft 21 as shown in FIG. **4*a*, the grounding point between the rear wheel 34 and the floor is moved to the right side of the center axis of the body 1. Then, the center of gravity of the body 1 is displaced to the left side of the original center of gravity. The front wheel 14 is rotated left on the supporting shaft 8 automatically for preventing the body 1 from falling down to the left hand. Then, the body 1** is inclined left in a manner to allow itself to whirl to the left. Movement of the front wheel to compensate for the shifting center of gravity occurs while the vehicle toy is moving, since a two-wheeled vehicle is dynamically stable.

Figure 4B:
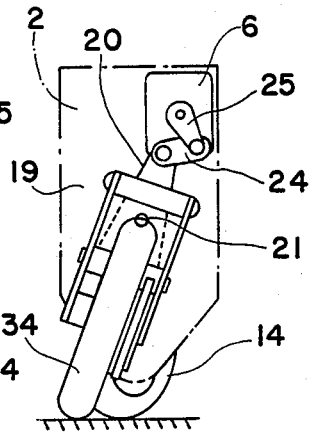

When the servo motor 6 rotates reversely to the above case, the supporting frame 19 rotates clockwise on the supporting shaft 21 as shown in FIG. **4*b* and the rear wheel 34 is returned to the vertical state and then shifted to the tilted-right state as shown in FIG. 4*b*. In this state, the grounding point between the rear wheel 34 and the road is moved to the left of the center axis. The center of gravity of the body 1 is displaced to the right side of the center axis. The front wheel 14 is rotated right on the supporting shaft 8 automatically in order to prevent the body 1 from falling down to the right hand. Then, the body 1 is inclined right in a manner to allow the body 1** to whirl to the right.

The actions of going straight and whirling right and left are carried out when the body 1 is running. When the center of gravity of the body 1 is displaced to the right or left side of the center axis by the rotation of the rear wheel 34, the front wheel 14 is rotatably supported in a manner to be rotated right and left in response to the displacement of the center of gravity.

As shown in FIG. 2, auxiliary legs 36, 36 are projected on both sides of the body 1. The tips of the auxiliary legs 36, 36 are projected toward the road and rotatably provide auxiliary wheels 37, 37. While the body 1 is running, these auxiliary wheels 37, 37 are spaced from the road. While it stops, these wheels serve to stand on the road to support the body 1 in cooperation with the front wheel 14 and the rear wheel 34. If the place where the body 1 stops is kept at a distance from the operator of the transmitter, the body 1 starts running by operating the transmitter again.

The present invention is configurated as set forth above. When the rear wheel interlocked with the servo motor is rotated to the right or left side of the center axis of the body 1 and the grounding point of the rear wheel on the road is moved while the body is running, the center of gravity is displaced right and left. The front wheel rotatably supported on the body 1 is rotated right and left in a manner to allow the body to be steered. This invention thus offers a radio control steering device for a two-wheeled vehicle toy which allows the body to be smoothly rotated right and left without giving any obstacle to straight travelling of the front wheel.

The many features and advantages of the present invention are apparent from the detailed specification, and thus, it is intended by the appended claims to cover all such features and advantages of the radio controlled steering device for a two-wheeled vehicle toy apparatus which fall within the true spirit and scope of the invention. Further, since numerous modifications and changes will readily occur to those skilled in the art based upon the disclosure herein, it is not desired to limit the invention to the exact construction and operation illustrated and described. Accordingly, all suitable modifications and equivalents may be resorted to, falling within the scope and the spirit of the invention.

What is claimed:

1. A radio controlled steering device for a two-wheeled vehicle toy, comprising:

a body having a forward portion and rearward portion;

a front wheel rotatably mounted in the forward portion of the body for rotation on a fork which rotates about an inclined axis the wheel being rotatable about a horizontal axis and rotates with the fork;

a rear wheel mounted on the rearward portion of the body in a frame, the frame being mounted for rotation about a substantially horizontally axis, the rear wheel being aligned with a center of gravity of the vehicle toy prior to initiating a turn;

drive means operatively connected to the rear wheel; and means for rotating the frame about its horizontal rotational axis to initiate a turn while the vehicle toy is moving in response to radio control signals to tilt the frame and thus shift the center of gravity of the vehicle toy thereby inducing the fork to rotate about the inclined axis in the direction of the shifted center of gravity.

2. A radio controlled steering device according to claim 1, wherein the rotating means comprises a servo motor housed in a stationary housing contained in the body and operated by radio control signals, and a linkage connecting the servo motor to the frame, the frame being pivotally connected to the stationary housing.

3. A radio controlled steering device according to claim 1, wherein the drive means comprises a drive motor mounted in the frame, and a transmission coupled to the drive motor for transmitting power from the drive motor to the rear wheel.

4. A radio controlled steering device according to claim 3, wherein the transmission comprises a power output shaft journalled in the frame and coupled to the drive motor, a sprocket coupled to the output shaft, and a belt running between the rear wheel and the sprocket.

5. A radio controlled steering device for a two-wheeled vehicle toy, comprising:

a body having a forward portion and a rearward portion;

a front wheel mounted in the forward portion of the body for yawing movement about a vertically inclined axis;

a rear wheel rotatably mounted in the rearward portion of the body for rolling movement about a substantially horizontal axis running in a longitudinally direction of the vehicle toy;

a stationary housing within the body, and a frame for mounting the rear wheel and being pivotally connected to the stationary housing;

drive means operatively connected to the rear wheel for rotating the wheel about a substantially horizontal rotational axis; and means for imparting rolling movement of the rear wheel while the vehicle toy is moving to thereby shift the center of gravity of the vehicle toy, and thus induce yawing movement of the front wheel in the direction of the shifted center of gravity.

6. A radio controlled steering device according to claim 5, wherein the means for imparting rolling movement comprises a servo motor mounted in the stationary hosing, and a linkage connecting the servo motor to the frame.

7. A radio controlled steering device according to claim 6, wherein the drive means comprises a drive motor mounted in the frame, and a transmission coupled to the drive motor for transmitting power from the drive motor to the rear wheel.

8. A radio controlled steering device according to claim 8, wherein the transmission comprises a power output shaft journalled in the frame and coupled to the drive motor, a sprocket coupled to the output shaft, and a belt running between the rear wheel and the sprocket.

* * * * *